United States Patent [19]

Gans

[11] 4,415,901

[45] Nov. 15, 1983

[54] LOW POWER BEAM SWITCHABLE ANTENNA ARRANGEMENT

[75] Inventor: Michael J. Gans, Monmouth Beach, N.J.

[73] Assignee: Bell Telephone Laboratories, Incorporated, Murray Hill, N.J.

[21] Appl. No.: 303,837

[22] Filed: Sep. 21, 1981

[51] Int. Cl.[3] ..... H01Q 19/06; H01Q 19/17

[52] U.S. Cl. ..... 343/754; 343/779

[58] Field of Search ..... 343/754, 779, 853, 854, 343/100 SA

[56] References Cited

U.S. PATENT DOCUMENTS

| | | | |
|---|---|---|---|
| 3,576,579 | 4/1971 | Appelbaum et al. | 343/778 |
| 3,631,503 | 12/1971 | Tang et al. | 343/754 |
| 3,835,469 | 9/1974 | Chen et al. | 343/754 |
| 3,914,768 | 10/1975 | Ohm | 343/779 |
| 4,236,161 | 11/1980 | Ohm | 343/781 |

*Primary Examiner*—Eli Lieberman

*Attorney, Agent, or Firm*—Erwin W. Pfeifle

[57] ABSTRACT

The present invention relates to a low power, beam switchable, antenna comprising a focusing reflector (14), a plurality of feedhorns ($10_1$–$10_N$) disposed on a surface (Σ) adjacent the focal surface of the focusing reflector, and an amplifying array (20, 24, 28) disposed in the aperture of the focusing reflector. A spherical wavefront launched by a feedhorn is reflected by the focusing reflector into a first planar wavefront which is intercepted by the amplifying array using a planar array of first feed elements ($20_1$–$20_X$) disposed on a fourier transform surface (Σ') of the surface on which the feedhorns are disposed. The signal produced by each of the first feed elements associated with a first planar wavefront is separately amplified with an equal relative phase shift to the other associated intercepted signals and reradiated in a second planar wavefront by a planar array of second feed elements ($28_1$–$28_X$) having the same tilt and direction as the first planar wavefront.

2 Claims, 1 Drawing Figure

LOW POWER BEAM SWITCHABLE ANTENNA ARRANGEMENT

BACKGROUND OF THE INVENTION

1. Field of the Invention

The present invention relates to a low power, beam switchable, antenna arrangement and, more particularly, to a multibeam antenna arrangement wherein beam directional changes are accomplished by appropriately switching between each of a plurality of feeds which transmit low power signals and are disposed on a surface adjacent the focal surface of the antenna. The low signal power beam is intercepted by a separate antenna array disposed on the fourier transform surface of the surface on which the feeds are located, and the intercepted signal at each of the array elements is amplified to a proper high power level for transmission, and with an equal relative phase shift, before reradiating the beam to a destined receiver by a second antenna array.

2. Description of the Prior Art

Multibeam antennas are commonly constructed by placing different feedhorns or clusters of feedhorns at different locations in the focal plane of a parabolic reflector, each location corresponding to a different beam direction. Thus the beam direction can be switched by switching between the various feedhorns. In this regard see, for example, U.S. Pat. Nos. 3,914,768 and 4,236,161 issued to E. A. Ohm on Oct. 21, 1975 and Nov. 25, 1980, respectively.

In such arrangements, if the transmitting amplifier is placed before the switch, the switch must handle high power and be nearly lossless. If amplifiers are instead placed in each of the output ports of the switch, the unused amplifiers for any given switch position are wasting power.

The problem remaining in the prior art is to provide a multibeam antenna arrangement which permits beam scanning and overcomes the above-mentioned amplifier positioning problem and also allows for simplification of the beam forming elements without any penalty in efficiency and reliability.

SUMMARY OF THE INVENTION

The foregoing problem has been solved in accordance with the present invention which relates to a low power, beam switchable, antenna arrangement and, more particularly, to a multibeam antenna arrangement wherein beam directional changes are accomplished by appropriately switching between each of a plurality of feeds which transmit low power signals and are disposed on a surface adjacent the focal surface of the antenna. The low signal power beam is intercepted by a separate antenna array disposed on the fourier transform surface of the surface on which the feeds are located, and the intercepted signal at each of the array elements is amplified to a proper high power level for transmission, and with an equal relative phase shift, before reradiating the beam to a destined receiver by a second antenna array.

Other and further aspects of the present invention will become apparent during the course of the following description and by reference to the accompanying drawing.

DETAILED DESCRIPTION

Figure 1:
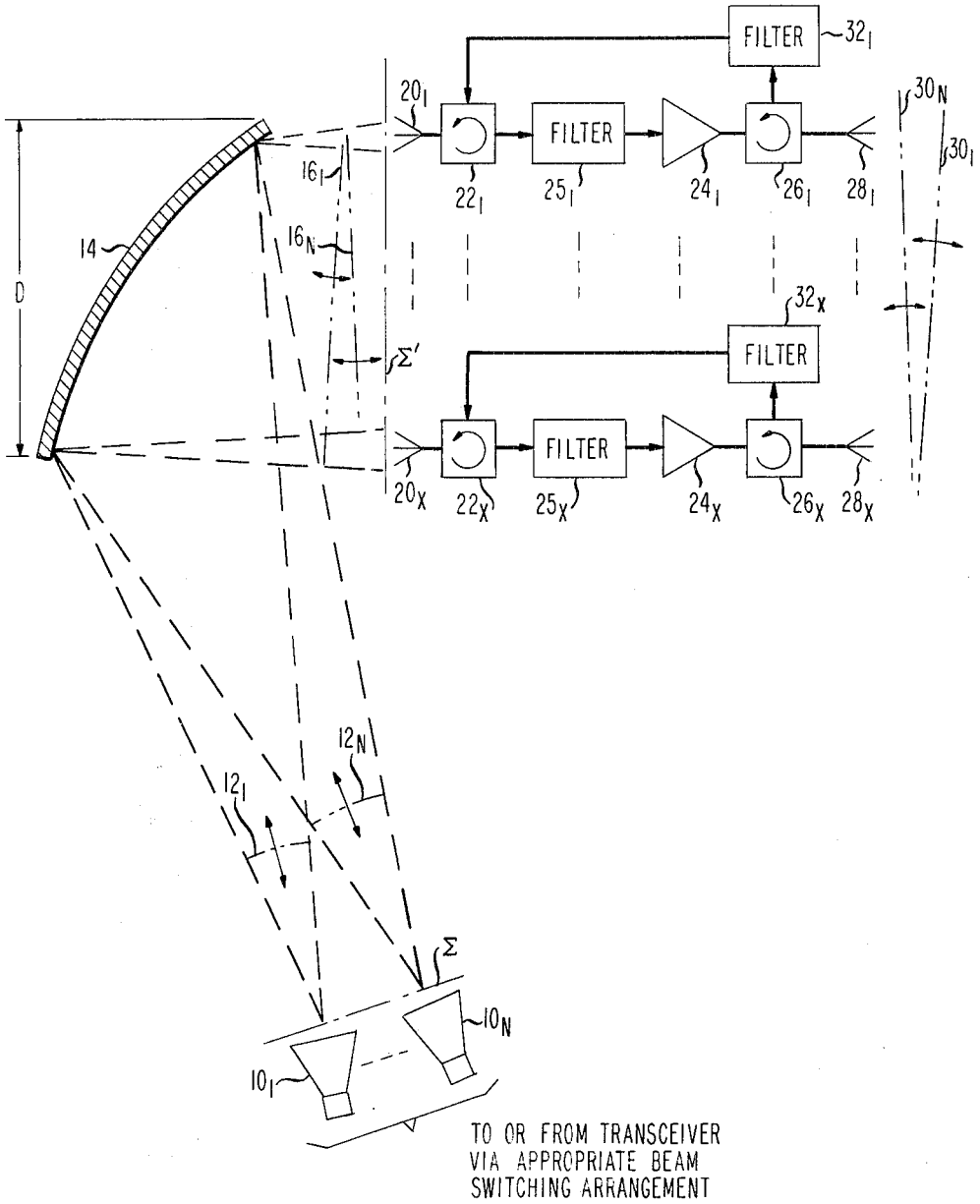
FIG. 1 illustrates a low power beam, switching, antenna system in accordance with the present invention for transmitting and receiving a message signal spot-beam.

FIG. 1 illustrates a low power, beam switchable, antenna arrangement in accordance with the present invention. In the antenna arrangement of FIG. 1, a plurality of feedhorns $\mathbf{10}_1$–$\mathbf{10}_N$ are positioned on a surface $\Sigma$ with each feedhorn 10 being capable of launching a spherical wavefront 12 toward a parabolic reflector 14 having a predetermined aperture D. For example, feedhorn $\mathbf{10}_1$ is capable of launching a spherical wavefront $\mathbf{12}_1$ which is reflected by reflector 14 into a planar wavefront $\mathbf{16}_1$ at the aperture which propagates in a predetermined first direction as determined by the position of feedhorn $\mathbf{10}_1$ on surface $\Sigma$. Similarly, feedhorn $\mathbf{10}_N$ is capable of launching a spherical wavefront $\mathbf{12}_N$ which is reflected by reflector 14 into a planar wavefront $\mathbf{16}_N$ at the aperture which propagates in a predetermined second direction as determined by the position of feedhorn $\mathbf{10}_N$ on surface $\Sigma$. Surface $\Sigma$, in accordance with the present antenna arrangement is located adjacent to the focal surface of reflector 14.

As was described hereinbefore with regard to the prior art, multibeam antennas are commonly constructed by placing different feedhorns or clusters of feedhorns at different locations on the focal plane of a parabolic reflector, each location corresponding to a different beam direction. Thus the beam direction can be switched by switching between the various feedhorns by using any arrangement which is well known in the art such as, for example, waveguide or stripline switches for high speed switching or solenoid activated magnetic waveguide switching for slower speed switching. In accordance with the present invention, the signals being launched in spherical wavefronts $\mathbf{12}_1$–$\mathbf{12}_N$ are low power signals which have not been amplified to the proper high power level needed for transmission to a remotely located receiver for which the signal is destined. Since the beam switching means need not handle high power level signals, such switching means, and more especially the beam forming means, can be simplified with lower power rated components.

In accordance with the present invention, a first planar array of feed elements $\mathbf{20}_1$–$\mathbf{20}_X$ is disposed on a fourier transform surface $\Sigma'$, of the surface $\Sigma$ in the aperture of and relatively close to reflector 14 to enable the feed elements $\mathbf{20}_1$–$\mathbf{20}_X$ to intercept each of the low power level planar wavefronts $\mathbf{16}_1$–$\mathbf{16}_N$. The intercepted signal at each of feed elements $\mathbf{20}_1$–$\mathbf{20}_X$ is directed by a separate associated one of circulators $\mathbf{22}_1$–$\mathbf{22}_X$ to a separate associated one of amplifying means $\mathbf{24}_1$–$\mathbf{24}_X$ via a separate associated one of filters $\mathbf{25}_1$–$\mathbf{25}_X$. Each of amplifying means 24 amplifies the signal from the associated feed element 20 to a predetermined high power level for transmission to the remote destinational receiver and with an equal relative phase shift to the other intercepted signals associated with the same planar wavefront 16 being amplified by the other amplifying means 24.

The high power level output signals from each of amplifying means $\mathbf{24}_1$–$\mathbf{24}_X$ is directed via a separate associated one of second circulators $\mathbf{26}_1$–$\mathbf{26}_X$ to a separate one of a second plurality of feed elements $\mathbf{28}_1$–$\mathbf{28}_X$ forming a second planar array. The second plurality of feed elements $\mathbf{28}_1$–$\mathbf{28}_X$ forming the second planar array comprises a configuration corresponding to the first plurality of feed elements $20_1$–$20_X$ forming the first planar array and are directed away from reflector 14.

In operation, a spherical wavefront 12 which is launched by one of feedhorns $10_1$–$10_N$ is reflected by reflector 14 into a planar wavefront 16 having a predetermined tilt and direction, and each of feed elements $20_1$–$20_X$ forming the first planar array intercepts the signal in the impinging portion of planar wavefront 16 when it arrives at each feed element 20. The signals intercepted by feed elements $20_1$–$20_X$ are filtered to pass only the intercepted signal and then individually amplified with an equal relative phase shift to the other signals of the associated intercepted planar wavefront 16. The amplified signals are reradiated by the plurality of second feed elements $28_1$–$28_X$ of the second planar array with approximately the same tilt and direction as the associated planar wavefront 16 arriving at feed elements $20_1$–$20_X$ of the first planar array.

To provide for bidirectionality of transmission in the arrangement of FIG. 1, it is assumed that transmissions in one direction use a first frequency band as, for example, 4 GHz and that transmissions in a second opposite direction use a second frequency band as, for example, 6 GHz. For signals launched by feedhorns $10_1$–$10_N$ in a first frequency band, filters $25_1$–$25_X$ are tuned to pass only signals in the first frequency band which are received at feed elements $20_1$–$20_X$ of the first planar array and to reject all other frequency band signals. For signals in the second frequency band arriving in each of planar wavefronts $30_1$–$30_N$ that were launched by various remote, spaced-apart, transmitters, such signals are received at feed elements $28_1$–$28_X$ of the second planar array.

The signals received at each of feed elements $28_1$–$28_X$ are directed by an associated one of second circulators $26_1$–$26_X$ to an associated one of a plurality of filters $32_1$–$32_X$. Filters $32_1$–$32_X$ function to pass only signals which are in the second frequency band and to reject all other signals such as, for example, any first frequency band signal component which may have been accidentally directed by an associated second circulator 26 from the output of the associated amplifier 24 to the input of the associated filter 32. The output signal from each of filters $32_1$–$32_X$ is directed by an associated one of first circulators $22_1$–$22_X$ to an associated one of first feed elements $20_1$–$20_X$ of the first planar array. These associated second frequency band signals are reradiated by feed elements $20_1$–$20_X$ of the first planar array in a planar wavefront 16 toward reflector 14 having the same tilt and direction as the associated planar wavefront 30 received at feed elements $28_1$–$28_X$. Reflector 14 reflects the planar wavefront 16 into a spherical wavefront 12 which is directed to a separate one of feedhorns $10_1$–$10_N$ destined to receive such signal due to the directionality of the received planar wavefront 30 and in turn associated planar wavefront 16.

It is to be understood that the above-described embodiments are simply illustrative of the principles of the invention. Various other modifications and changes may be made by those skilled in the art which will embody the principles of the invention and fall within the spirit and scope thereof. For example, if the antennas arrangement of FIG. 1 is to be used for transmission purposes only, circulators $22_1$–$22_X$ and $26_1$–$26_X$, and filters $25_1$–$25_X$ and $32_1$–$32_X$ could be eliminated and the inputs of amplifying means $24_1$–$24_X$ could be directly connected to feed elements $20_1$–$20_X$ of the first planar array and the outputs of amplifying means $24_1$–$24_X$ could be directly connected to feed elements $28_1$–$28_X$ of the second planar array. It is to be further understood that any suitable arrangement known in the art and capable of doing the function described hereinbefore for each of filters 25 and 32, circulators 22 and 26 and amplifying means 24 could be used. Additionally, by properly choosing the number of first and second feed elements of the first and second planar array, respectively, relative to the amplifier means capacity, the amplifying array can handle many beams simultaneously with negligible loss in performance due to intermodulation and signal suppression.

What is claimed is:

1. A low power, beam switchable, antenna arrangement comprising:

a focusing reflector (14) comprising a predetermined aperture and being capable of converting a spherical wavefront into a planar wavefront at the aperture thereof; and a plurality of feedhorns ($10_1$–$10_N$), each feedhorn being capable of radiating a spherical wavefront (12) in a beam of electromagnetic energy for reflection by the focusing reflector into a planar wavefront (16) at the aperture thereof characterized in that the plurality of feedhorns are disposed beside each other on a surface ($\Sigma$) adjacent to but not forming part of a focal surface of the focusing reflector, and the beams of electromagnetic energy capable of being radiated by the plurality of feedhorns are each of a low power level, the antenna arrangement further comprising:

an amplifying array comprising:

a plurality of first feed elements ($20_1$–$20_X$) forming a first planar array disposed to cover the aperture of, and be directed at, the focusing reflector on a fourier transform surface ($\Sigma'$) of the surface on which the plurality of feedhorns are disposed for receiving a planar wavefront reflected by the focusing reflector;

a plurality of second feed elements ($28_1$–$28_X$) forming a second planar array corresponding in configuration to the first planar array and disposed to cover the aperture of, and directed away from, the focusing reflector; and a plurality of amplifying means ($24_1$–$24_X$), each amplifying means interconnecting a separate corresponding feed element of the first and second planar arrays and being capable of amplifying a low power signal with its associated phase shift as received at the associated first feed element to a predetermined high power level for radiation by the associated second feed element of the second planar array to a remote destinational receiver.

2. An antenna arrangement according to claim 1 wherein each of the plurality of feedhorns is disposed on said surface ($\Sigma$) to radiate sequential spherical wavefronts in a beam which when reflected by the focusing reflector forms sequential first planar wavefronts which have a predetermined tilt and direction characterized in that each of said first feed elements of the amplifying means is capable of receiving a portion of a first planar wavefront formed by the focusing reflector which impinges thereon and converting such portion of said first planar wavefront into a separate signal having a phase shift relative to the signals produced by the other first feed elements from their associated portion of said first planar wavefront which corresponds to said tilt and direction of said received first planar wavefront for subsequent amplification by the associated one of said plurality of amplifying means; and said plurality of second feed elements of said amplifying array are capable of radiating the associated amplified signals from said plurality of amplifying means in a second planar wavefront having a predetermined tilt and direction which corresponds to the tilt and direction of the associated first planar wavefront received at the plurality of first feed elements.

* * * * *